US005482267A

United States Patent [19]

Haupenthal

[11] Patent Number: 5,482,267

[45] Date of Patent: Jan. 9, 1996

[54] DEVICE FOR ADJUSTING THE POSITION OF SUCTION-TYPE GRIPPERS ON A SHEET-TRANSFER DRUM

[75] Inventor: Rudi Haupenthal, Epfenbach, Germany

[73] Assignee: Heidelberger Druckmaschinen AG, Heidelberg, Germany

[21] Appl. No.: 240,922

[22] Filed: May 10, 1994

[30] Foreign Application Priority Data

May 10, 1993 [DE] Germany ..... 43 15 540.5
May 10, 1993 [DE] Germany ..... 43 15 515.4

[51] Int. Cl.[6] ..... B65H 5/12

[52] U.S. Cl. ..... 271/276; 271/95; 271/196

[58] Field of Search ..... 271/94, 95, 96, 271/196, 197, 276, 91

[56] References Cited

U.S. PATENT DOCUMENTS

| | | | |
|---|---|---|---|
| 3,599,541 | 8/1971 | Allen | 271/95 |
| 4,982,207 | 1/1991 | Tunmore et al. | 271/276 |
| 5,060,931 | 10/1991 | Morita | 271/196 |

FOREIGN PATENT DOCUMENTS

| | | | |
|---|---|---|---|
| 730100 | 5/1955 | United Kingdom | 271/94 |
| 1058134 | 2/1967 | United Kingdom . | |
| 2084965 | 4/1982 | United Kingdom . | |

OTHER PUBLICATIONS

UK Search Report.

*Primary Examiner*—H. Grant Skaggs
*Attorney, Agent, or Firm*—Herbert L. Lerner; Laurence A. Greenberg

[57] ABSTRACT

A device for adjusting the position of suction-type grippers on a sheet-transfer drum, wherein the suction-type grippers, disposed basically along at least one generating line, are displaceable perpendicularly to a sheet-transport direction and are fixably disposed, includes a multi-member differential worm-gear unit having output members secured against rotation relative thereto, the suction-type grippers being fastened to the output members, and precisely one rotational input member disposed on the differential worm-gear unit for simultaneously adjusting all of the suction-type grippers.

11 Claims, 5 Drawing Sheets

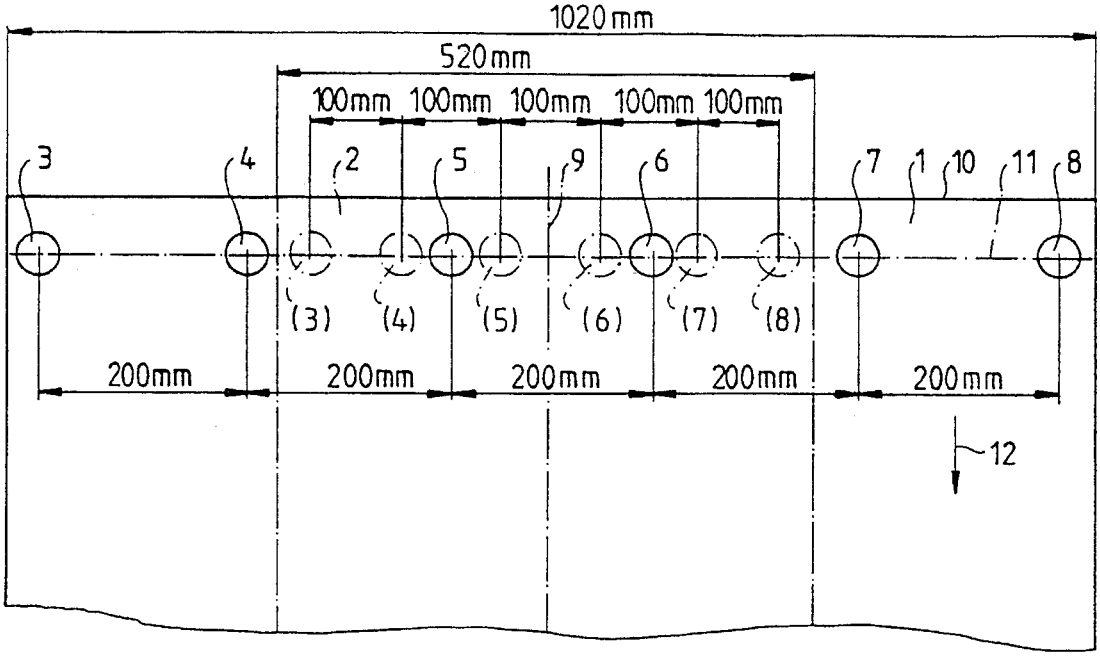
Fig. 1
Fig. 3
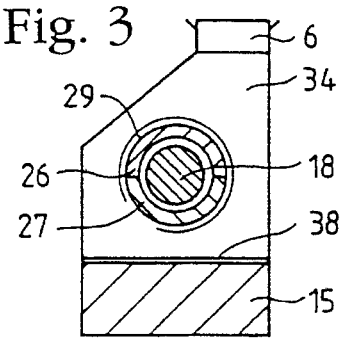
Fig. 4
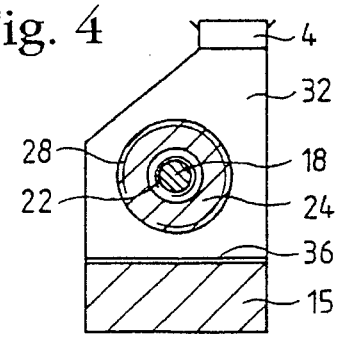

DEVICE FOR ADJUSTING THE POSITION OF SUCTION-TYPE GRIPPERS ON A SHEET-TRANSFER DRUM

SPECIFICATION

The invention relates to a device for adjusting the position of suction-type grippers on a sheet-transfer drum and, more particularly, to such a device which is usable in sheet-fed rotary printing presses in which sheet-transfer drums are provided for transport of sheets, the sheets being held in grippers on the sheet-transfer drums and at least some of the grippers being in the form of suction-type grippers.

Whenever there is a job change in order to print sheets of a different size, it is advantageous to adapt the position of the suction-type grippers on the outer cylindrical surface of the sheet-transfer drum to suit the new size or format to be printed. For this purpose devices for adjusting the position of suction-type grippers are used, the devices enabling an individual or group-wise adjustment of the suction-type grippers in the rotational direction and perpendicularly to the rotational direction of the sheet. Simultaneously with the adjustment of the position of the suction-type grippers, it is possible for the sheet-holding surface on the outer cylindrical surface to be adapted to suit the new sheet size or format to be printed.

Heretofore known devices achieve an adjustment to a new sheet size or format by adjusting the suction-type grippers, in accordance with the sheet length, by a defined angle about the rotational axis of the sheet-transfer drum and by rendering inoperative the suction-type grippers lying outside the new sheet width in a direction perpendicular to the sheet-transport direction. That is, the position of the suction-type grippers in the direction perpendicular to the sheet-transport direction is maintained, the suction air being removed only from those suction-type grippers which are not needed (Japanese Patents 4-161336, 4-153039 and 4-158041).

A disadvantage thereof is that not all suction-type grippers provided transversely to the sheet transport direction are used for holding small-size or small-format sheets and that a special device must be provided for turning off the non-required suction-type grippers, due to which such devices are both material and cost-intensive and do not permit a maximum possible holding force.

In simple constructions, it is possible to set the suction-type grippers manually to a new sheet size or format transversely to the sheet-transport direction. For this purpose, the suction-type grippers may be fixed on a straight guide by means of a clamping screw. In order to adjust the suction-type grippers, the clamping screws of the suction-type grippers are individually loosened and the suction-type grippers are displaced, preferably along a scale, to a new position within the straight guide. The suction-type grippers are re-clamped in the new positions. The suction-type grippers are connected to a suction-air source through the intermediary of flexible tubes and a rotary lead-through.

Such constructions have the disadvantage that the change-over of the suction-type grippers to a new sheet size or format is time-consuming, the sheet-transfer drums usually being surrounded by further machine elements of the printing press, so that access to the clamping screws for manual adjustment is rendered more difficult and the positioning accuracy is adversely affected. For example, a double-size sheet-transfer drum, in comparison with a plate or blanket cylinder, for example, has two rows of suction-type grippers, which, for change-over, must be rotated further by at least 180°. Furthermore, there is the risk that, due to errors in setting, the suction-type grippers will be set differently on the two halves of the sheet-transfer drum.

It is accordingly an object of the invention to provide a device for adjusting the position of the suction-type grippers which affords a fast and precise adjustment of the suction-type grippers transversely to the sheet-transport direction, all of the suction-type grippers disposed across the width of a sheet-transfer drum being usable for holding the sheets for each sheet size or format.

With the foregoing and other objects in view, there is provided, in accordance with the invention, a device for adjusting the position of suction-type grippers on a sheet-transfer drum, wherein the suction-type grippers, disposed basically along at least one generating line, are displaceable perpendicularly to a sheet-transport direction and are fixably disposed, comprising a multi-member differential worm-gear unit having output members secured against rotation relative thereto, the suction-type grippers being fastened to the output members, and precisely one rotational input member disposed on the differential worm-gear unit for simultaneously adjusting all of the suction-type grippers.

In accordance with another feature of the invention, the input member is part of a gear drive, and a drive motor for the gear drive is included, the drive motor being connected to a control device having an input for receiving signals relating to the sheet format.

In accordance with a first alternate feature of the invention, the input member is a gearwheel.

In accordance with a second alternate feature of the invention, the input member is a toothed-belt pulley.

In accordance with a third alternate feature of the invention, the input member is a pinion of a chain drive.

In accordance with a further feature of the invention, the differential worm-gear unit contains a threaded spindle fixedly mounted on the sheet-transfer drum, the threaded spindle being disposed perpendicularly to the sheet-transport direction and, starting from the center thereof, which is in the center of the width of the sheet-transfer drum, being formed with a right-hand thread and a left-hand thread having single and double pitch, respectively, a first threaded sleeve disposed on either side of the center on each of the right-hand thread and the left-hand thread of the threaded spindle, both of the threaded sleeves being symmetrical with respect to the center and being formed as clutch halves of a dog clutch, the threaded sleeves, respectively, further including, towards the center, a first threaded section with a male left-hand thread and a right-hand thread of a half and a single pitch, respectively, respective output members of a first suction-type gripper being seated on each first threaded section, and the threaded sleeves, respectively, including, directly after the first threaded section, a second section with a male right-hand thread and a left-hand thread of a half and a single pitch, respectively, and including output members of a second suction-type gripper seated on each second threaded section, second threaded sleeves, respectively, connected coaxially on each of the first threaded sleeves on the threaded spindle on the side facing away from the center, the second threaded sleeves, respectively, having a male right-hand thread and a left-hand thread of 1.5-fold and three-fold pitch, respectively, respective output members of third suction-type grippers being positioned on the male threads, one of the second threaded sleeves on the end facing away from the center being drivable by a gearwheel.

In accordance with an added feature of the invention, the first and the second threaded sleeves are each fixedly screwed together, and the male threads thereof are of like diameter.

In accordance with an additional feature of the invention, the second threaded sleeves are each held on the threaded spindle at the end facing away from the center, and a slide bearing and a bushing are included.

In accordance with yet another feature of the invention, the input member is lockable.

In accordance with yet a further feature of the invention, the differential worm-gear unit has threads which are self-locking.

In accordance with yet an added feature of the invention, the device includes a rotatable threaded spindle having a left-hand thread section and a right-hand thread section, respective nuts seated on the outside of the threaded spindle on each of the left-hand thread and the right-hand thread, displaceable drivers disposed on the threaded spindle between the nuts, compression springs disposed between the nuts and the respectively adjacent drivers and between adjacent drivers in the axial direction with respect to the threaded spindle, one of the suction-type grippers, respectively, being connected to each nut and to each driver.

In accordance with another aspect of the invention, there is provided a device for adjusting the position of suction-type grippers on a sheet-transfer drum, wherein the suction-type grippers, disposed basically along at least one generating line, are displaceable perpendicularly to a sheet-transport direction and are fixably disposed, comprising telescopically disposed elements to which the suction-type grippers are fastened, the elements being formed in the interior thereof with a respective hollow space, the hollow space being connected to at least one suction-air source, the elements being sealed with respect to one another at guiding surfaces thereof.

In accordance with a further feature of the invention, the telescopically disposed elements are formed as hollow cylinders secured against rotation, and sealing rings are included serving as sealing and fixing members between the elements.

In accordance with an added feature of the invention, the telescopically disposed elements are formed with precisely one common hollow space connected, through the intermediary of a rotary lead-through, to precisely one suction-air source.

In accordance with an additional feature of the invention, three of the telescopically disposed elements are disposed on each side of the center of the width of the sheet-transfer drum, and cylindrical guiding elements are included, outer ones of the telescopically disposed elements being seated by means of sealing rings on the cylindrical guiding elements.

In accordance with yet another feature of the invention, one of the cylindrical guiding elements is tubular in form and is connected to a suction-air source.

In accordance with a concomitant feature of the invention, respective pairs of the telescopically disposed elements are formed of mutually adjacent elements having overlapping regions, the elements of the pairs thereof having entrainer elements at an end of the overlapping regions thereof.

Thus, the suction-type grippers are fastened, secured against rotation, on output members of a multi-member differential worm-gear unit, precisely one rotational input member being provided on the differential worm-gear unit for the simultaneous adjustment of all the suction-type grippers. It is possible for a plurality of such devices to be provided on a sheet-transfer drum. The devices may be disposed singly, doubly or multiply in order to hold the leading or trailing edge of a sheet on the sheet-transfer drum.

The invention has the advantage that, through the rotation of just one input member, a plurality of suction-type grippers can simultaneously be brought into a predetermined position, with the result that the adjustment operation is quickly performed. The accuracy of adjustment is determined practically only by the accuracy of the differential worm-gear unit and of the drive system thereof. A further advantage lies in that, due to the self-locking of the fine-pitch threads, the suction-type grippers no longer need to be clamped individually.

Adjustment may be performed manually or by means of motors, it being possible, through the dimensioning of the pitch of the threads involved in positioning, for the suction-type grippers to be equally spaced in relation to one another after being set to any desired sheet size or format.

Fully automatic adjustment can be achieved in that the drive motor, which adjusts an input member of the differential worm-gear unit through the intermediary of a gear drive, is connected to a control device of the sheet-fed printing press, the control device being capable of being supplied with signals relating to the sheet size or format.

An axially displaceable gearwheel, a toothed-belt pulley or a pinion of a chain drive may be provided as the input element driving the differential worm-gear unit. After adjustment thereof, the suction-type grippers may be fixed in their new position, for example, in that the driving element or an element of the gear drive connected up-line thereto is lockable.

A low-cost different embodiment of the invention is achieved when a rotatable threaded spindle with both left-hand and right-hand threaded sections is provided, having a nut seated on the outside of each threaded section. Furthermore, in the different embodiment, rotatable drivers or entrainers are provided between the nuts on the threaded spindle, compression springs of, preferably, identical spring constant being disposed between the nuts and the adjacent drivers as well as between adjacent nuts. A suction-type gripper is connected to each nut and to each driver, the suction-type gripper being axially displaceable with the respective nut or driver.

A further disadvantage is the fact that the adjustment travel of the suction-type grippers is limited by the tube connection, with the tube having to be laid in a large arc, because, otherwise, there would be the danger that, particularly in the case of smaller sheet sizes and small bending radii, the tube might be constricted by the vacuum generated by the suction-air source.

The object of the invention is achieved in that, in order to adjust the positions of the suction-type grippers in the direction perpendicular to the sheet-transport direction, the suction-type grippers are attached on telescopically disposed elements, with the elements each forming in their interior a hollow space, the hollow space being connected to at least one suction-air source, and with the elements being sealed with respect to one another at the guiding surfaces thereof.

The suction-type grippers may be adjusted either manually or by means of a motor with the aid of a gear drive. No additional tools are required in order to fix the suction-type grippers after the adjustment thereof. The suction-type grippers remain in their positions as a result of frictional forces which are generated by sealing rings between the telescopic elements. The apparatus permits fast and easy-to-manage adjustment. Due to the suction-air connection through the intermediary of the hollow space formed by the elements, the construction takes up only little overall space. The installation of tubes with the aforementioned disadvantages is unnecessary.

A plurality of such devices for adjusting suction-type grippers may be provided according to the number of sheets to be transported on the sheet-transfer drum, it being possible for the devices to be connected to one suction-air source.

The telescopic elements may advantageously be in the form of hollow cylinders secured against rotation, wherein the outer telescopic elements, with respect to the center of the sheet width, may be disposed on cylindrical guiding elements, and wherein the telescopic elements may slide on the guiding elements by means of sealing rings. The suction-air connection may be established through the intermediary of a bore formed in the interior of one of the cylindrical guiding elements. In order to ensure that, during displacement, the telescopic elements do not go outside the envisaged guiding area, a driving element, such as a driving pin, may be provided at each end of the overlapping region between two adjacent telescopic elements. Furthermore, the range of motion may be limited by means of stops disposed on the cross-member lying parallel to the rotational axis of the sheet-transfer drum.

Other features which are considered as characteristic for the invention are set forth in the appended claims.

Although the invention is illustrated and described herein as embodied in a device for adjusting the position of suction-type grippers on a sheet-transfer drum, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIG. 1 is a fragmentary diagrammatic plan view of a sheet-transfer drum showing the relative positions of the suction-type grippers before and after the positioning thereof;

FIG. 3 is a cross-sectional view of FIG. 2 taken along the line III—III in the direction of the arrows;

FIG. 4 is a cross-sectional view of FIG. 2 taken along the line IV—IV in the direction of the arrows;

Figure 2:
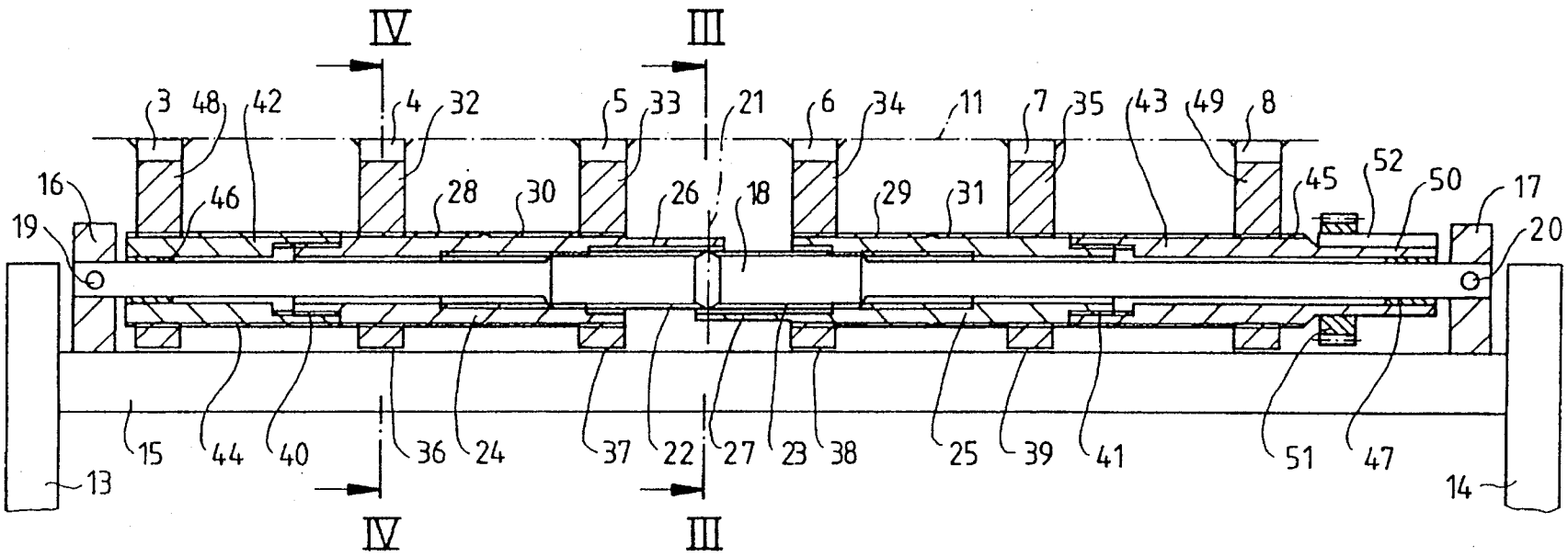
FIG. 2 is a longitudinal sectional view of an embodiment of the device according to the invention with a three-member differential worm-gear unit.

Referring now to the drawings and, first, particularly to FIG. 1 thereof, there is shown therein diagrammatically two sheets 1, 2 of different size or format in a developed view of a sheet-transfer drum. Further shown are contact surfaces of six suction-type grippers 3, 4, 5, 6, 7, 8, the suction-type grippers 3, 4, 5, 6, 7, 8 being disposed symmetrically with respect to a center line 9 of the sheets 1, 2 or of the sheet-transfer drum. The suction-type grippers 3, 4, 5, 6, 7, 8 serve to hold the trailing edge 10 of the respective sheet 1 or 2.

For the sheet 1 with a width of 1020 mm, for example, the suction-type grippers 3, 4, 5, 6, 7, 8 are disposed at a distance of 200 mm from the adjacent suction-type grippers 3, 4, 5, 6, 7, 8. In order to achieve an adjustment of the suction-type grippers 3, 4, 5, 6, 7, 8 to a width of 520 mm, for example, of the smaller sheet 2, the suction-type grippers 3, 4, 5, 6, 7, 8 are displaced along the generating line 11 or perpendicularly to the sheet-transport direction 12 into the positions represented by the broken lines, so that the suction-type grippers 3, 4, 5, 6, 7, 8, after displacement thereof, are at a distance of 100 mm from an adjacent suction-type gripper 3, 4, 5, 6, 7, 8. On their travel towards the center line 9, the outer suction-type grippers 3 and 8 each cover a distance of 250 mm, the suction-type gripper pair 4, 7 covering a distance of 150 mm and the inner suction-type gripper pair 5, 6 a distance of 50 mm. Consequently, the ratio of the distances covered by the suction-type gripper pairs 3, 8; 4, 7 and 5, 6 is 5:3:1. The outer suction-type grippers 3, 8 are, after adjustment, 50 mm closer to the center line 9 than the suction-type grippers 5, 6, which were in the center prior to adjustment.

FIG. 2 shows a differential worm-gear unit of the type provided according to the invention for the adjustment of the position of the suction-type grippers 3, 4, 5, 6, 7, 8. Attached to the outside of a rectangular guide rod 15, mounted between side parts 13, 14 of the sheet-transfer drum, are holding blocks 16, 17, formed with bores wherein the ends of a threaded spindle 18 are fastened with pins 19, 20. The threaded spindle 18 is perpendicular to the sheet-transport direction 12 and parallel to the generating line 11. Starting from a central plane 21 and the center line 9, respectively, which lies in half the width of the outer cylindrical surface of the sheet-transfer drum carrying the sheets 1 or 2, the threaded spindle 18 has, on either side of the central plane 21, a male left-hand thread 22 and a male right-hand thread 23. A first threaded sleeve 24, 25, respectively, is seated on each of the left-hand thread 22 and the right-hand thread 23. The threaded sleeves 24, 25 are formed, at the ends facing the central plane 21, as clutch halves 26, 27 of a zero-play dog or jaw clutch, as is shown in greater detail in FIG. 3. Furthermore, the threaded sleeves 24, 25 are each provided with two sections having a male right-hand thread 28, 29 and a male left-hand thread 30, 31. An output member 32, 33, 34 and 35 for the suction-type grippers 4, 5, 6 and 7 runs on each of the right-hand thread 28, 29 and the left-hand thread 30, 31. For securing against rotation, the output members 32, 33, 34 and 35 are each formed with a notched surface 36, 37, 38, 39, which can slide on the guide rod 15.

Figure 9:
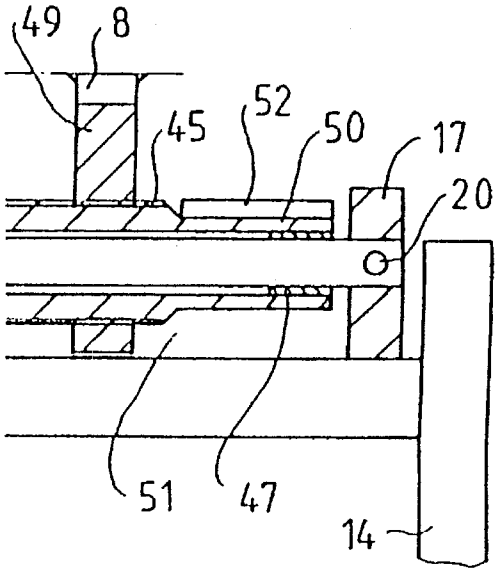
FIG. 9 is a similar view of another alternative drive member.
Figure 8:
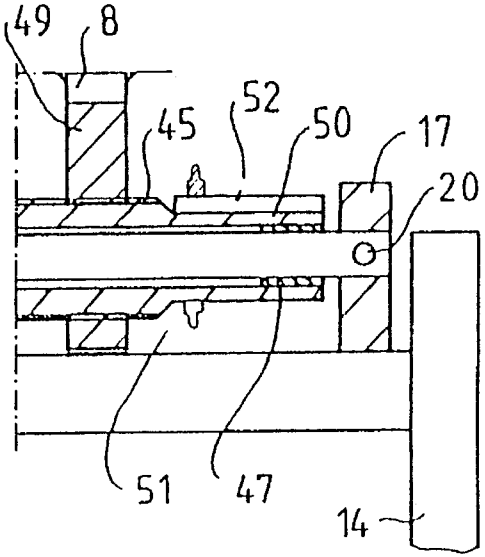
FIG. 8 is a fragmentary view corresponding to a position of FIG. 2 and illustrating an alternative drive member.

Screwed onto threaded stems 40, 41 of the threaded sleeves 24, 25 at the ends facing away from the central plane 21 are further threaded sleeves 42, 43, each of which has a male right-hand thread 44 and a left-hand thread 45. At the ends facing away from the central plane 21, the threaded sleeves 42, 43 are rotatably and axially displaceably held on the threaded spindle 18 by bushings 46, 47. Further output members 48, 49 for suction-type grippers 3, 8 are seated on the right-hand thread 44 and the left-hand thread 45. Seated on a pin 50 machined onto the end facing away from the central plane 21 of the threaded sleeve 43 is a gearwheel 51 which, guided by a feather key 52, is displaceable with respect to the pin 50. In alternative embodiments the gearwheel 51 may be replaced by a pinion 51' of a chain drive (FIG. 8) or a toothed belt pulley 51" (FIG. 9).

FIG. 2 shows the suction-type grippers 3, 4, 5, 6, 7, 8 in a position for the maximum sheet size or format. For adjustment of the position of the suction-type grippers, a drive is set in motion which is connected to the gearwheel 51. Due to the connection with the feather key 52, the rotation of the gearwheel 51 causes a rotation of the threaded sleeves 43 and 25. The threaded sleeves 24 and 42 are simultaneously rotated through the intermediary of the clutch halves 27, 26. The output members 32, 33, 34, 35, 48, 49 are displaced, together with the suction-type grippers 3, 4, 5, 6, 7, 8, in the direction of the central plane 21. If the left-hand thread 22 and the right-hand thread 23 have a pitch $p_1=1$, the right-hand threads 28, 29 and the left-hand threads 30, 31 have a pitch $P_2=0.5$, and the right-hand thread 44 and the left-hand thread 45 have a pitch $P_3=1.5$, then the suction-type grippers 3, 4, 5, 6, 7, 8 will be displaced, at 100 revolutions of the gearwheel 51, about the aforementioned paths to the position for the smallest sheet size or format. Through this dimensioning of the pitches $p_1$, $P_2$ and $p_3$ all suction-type grippers 3, 4, 5, 6, 7, 8 are always at the same distance or spacing from an adjacent suction-type gripper 3, 4, 5, 6, 7, 8. Similar conditions are achieved also if the pitches $p_1=2$, $P_2=1$ and $P_3=3$ are selected. The otherwise non-illustrated drive system for the gearwheel 51 may be connected to a central printing-press control, from which the positioning can be remotely controlled.

Figure 5:
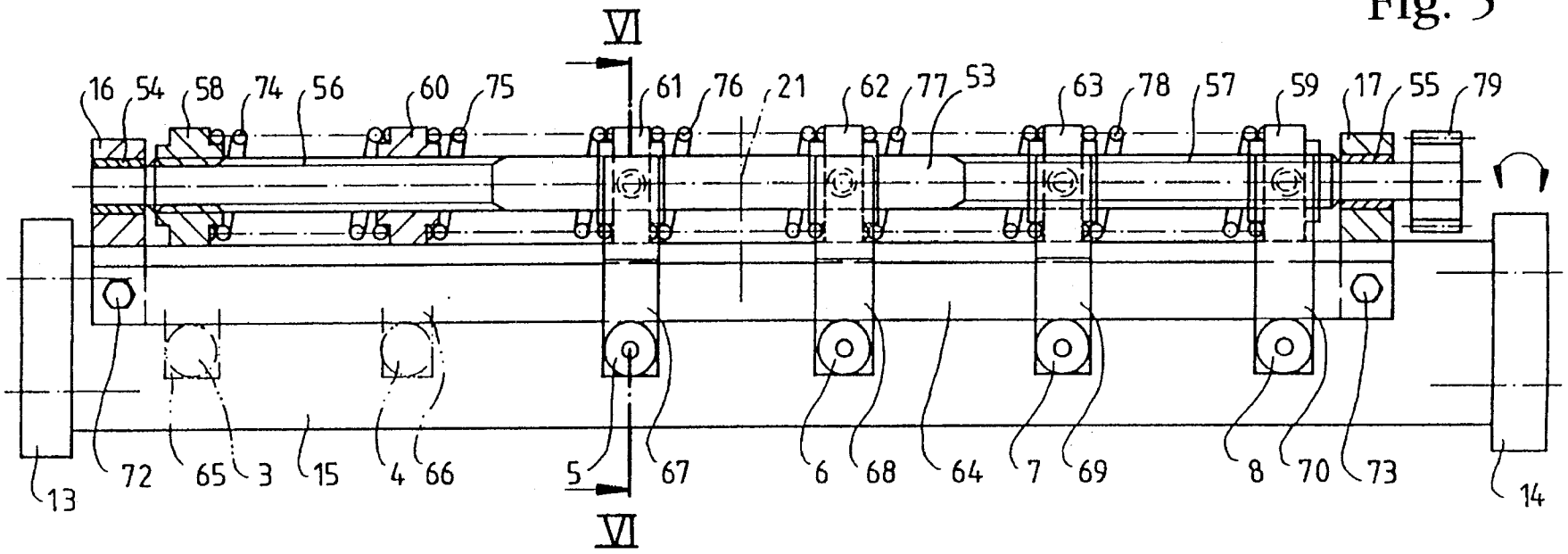
FIG. 5 is a longitudinal view, partly in section, of another embodiment of the device with a rotatable threaded spindle.
Figure 6:
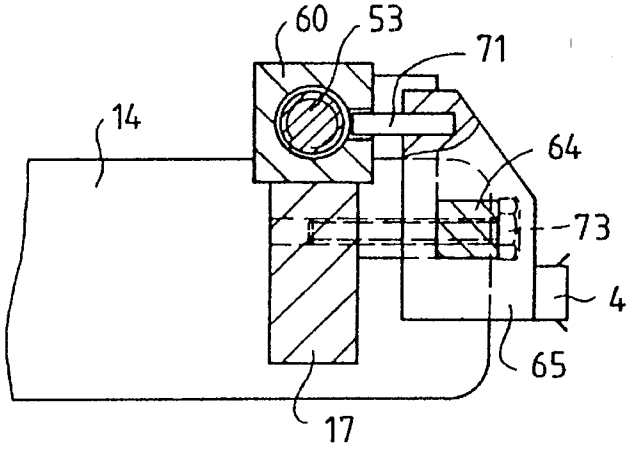
FIG. 6 is a cross-sectional view of FIG. 5 taken along the line V—V in the direction of the arrows.

FIGS. 5 and 6 show a further embodiment of the invention. A rotatable threaded spindle 53 is axially fixedly held in bearings 54, 55. The threaded spindle 53 has a section with a left-hand thread 56 and a section with a right-hand thread 57. Mounted on the outside of the threaded spindle 53 are two nuts 58, 59, which are secured against rotation. Furthermore, drivers or entrainers 60, 61, 62, 63 are slipped onto the threaded spindle 53. Both the nuts 58, 59 and also the drivers 60 61, 62, 63 are each associated with a holder 65, 66, 67, 68, 69, 70 for the suction-type grippers 3, 4, 5, 6, 7, 8, the holders 65, 66, 67, 68, 69, 70 being axially displaceable on a guide 64. The nuts 58, 59, the drivers or entrainers 60, 61, 62, 63 and the holders 65, 66, 67, 68, 69, 70 are interconnected through the intermediary of driving pins 71. The guide 64 is attached to the holding blocks 16, 17 by bolts 72, 73. Compression springs 74, 75, 76, 77, 78, coaxial with the threaded spindle 53, are disposed between the nuts 58, 59 and the drivers 60, 63 and between the drivers 60, 61; 61, 62; 62, 63. Laterally from the holding block 17, a gearwheel 79 is seated on the threaded spindle 53. When the threaded spindle 53 is rotated through the intermediary of the gearwheel 79, the nuts 58, 59 are moved in the direction of the central plane 21. If the compression springs 74, 75, 76, 77, 78 have the same spring constant and the pitches of the left-hand thread 56 and of the right-hand thread 57 are identical, then the suction-type grippers 3, 4, 5, 6, 7, 8 are adjusted by the same amount. Also after adjustment, the suction-type grippers 3, 4, 5, 6, 7, 8 are equally spaced. This is assured even if, in the initial or starting state, the distances or spacing between the suction-type grippers 3, 4, 5, 6, 7 were not identical due to different lengths of compression springs 74, 75, 76, 77, 78 with identical spring constants.

Figure 7:
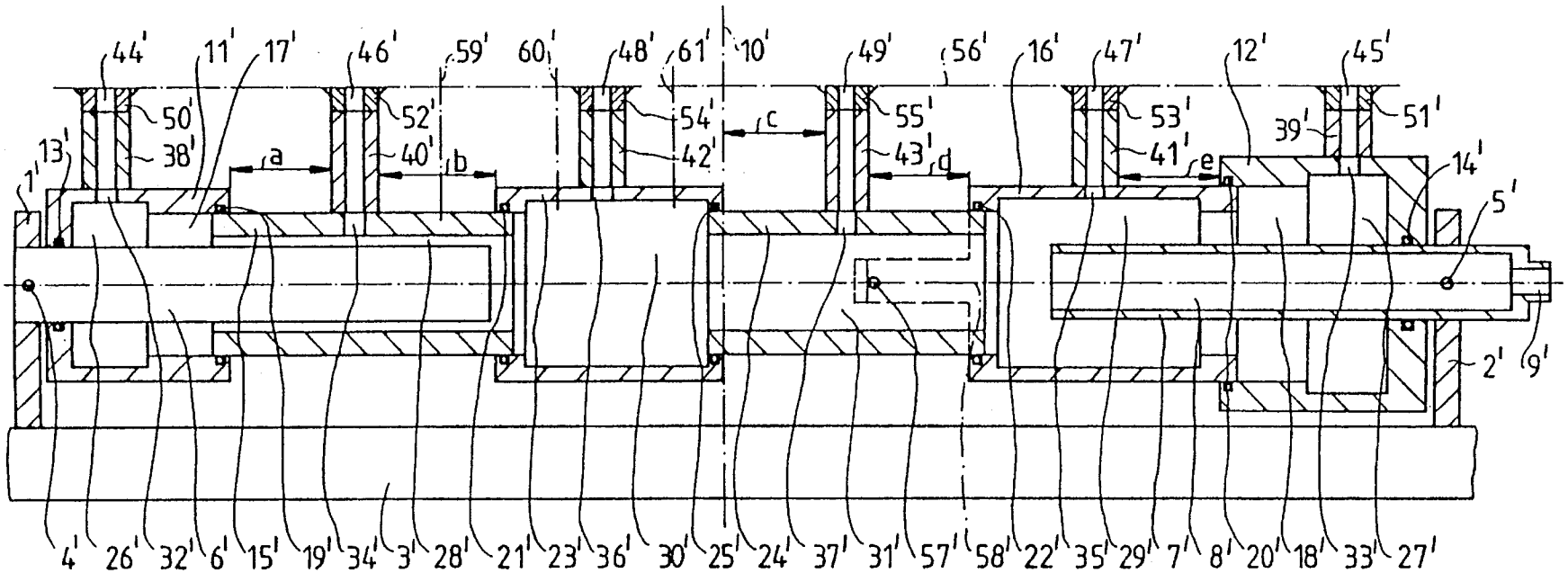
FIG. 7 is a view like that of FIG. 2 of another embodiment of the invention.

FIG. 7 is a view like that of FIG. 2 of another embodiment of the invention. As shown therein, the device according to the invention is disposed on a cross-member 3' by means of two holding blocks 1', 2'. The cross-member 3' is attached, parallel to the rotational axis, on a non-illustrated sheet-transfer drum Two cylindrical guiding elements 6', 7' are held in the holding blocks 1', 2' by means of pins 4', 5'. The guiding elements 6', 7' are disposed coaxially with respect to one another, the guiding element 7' being formed with a bore 8' and being provided laterally with a suction-air connection 9'. An outer cylindrical telescopic element 11', 12', as viewed with respect to a central plane 10', slides on each of the guiding elements 6', 7', sealing rings 13', 14' being provided between the telescopic elements 11', 12' and the guiding elements 6', 7'. Disposed towards the central plane 10' and coaxial with the telescopic elements 11', 12' are further telescopic elements 15', 16', which are each inserted into a hole 17', 18' of the respective telescopic element 11', 12' and are sealed with respect thereto by means of sealing rings 19', 20'. Seated with the aid of sealing rings 21', 22', towards the central plane 10' on the outside diameter or in the interior of the telescopic elements 15', 16' are further, coaxial telescopic elements 23', 24', which overlap one another in the region of the central plane 10', a further sealing ring 25' being provided in the overlapping region. All telescopic elements 11', 12', 15', 16', 23', 24' have inner, interconnected hollow spaces 26', 27', 28', 29', 30', 31', which are connected, through the intermediary of holes 32', 33', 34', 35', 36', 37' and sleeves 38', 39', 40', 41', 42', 43', to intake openings 44', 45', 46', 47', 48', 49' Of suction-type grippers 50', 51', 52', 53', 54', 55'. The axes of the sleeves 38', 39', 40', 41', 42', 43' are situated in one plane and are of such length that the intake openings 44', 45', 46', 47', 48', 49' are situated in a plane 56' in which a sheet which is to be transported is to lie.

Adjacent telescopic elements 11', 12', 15', 16', 23', 24' are coupled to a driving pin 57' in such a manner that, when the suction-type grippers 50', 51', 52', 53', 54', 55' are adjusted, the overlapping of the telescopic elements 11', 12', 15', 16', 23', 24' is assured. The telescopic elements 11', 12', 15', 16', 23', 24' are secured against rotation.

In FIG. 7, the suction-type grippers 50', 51', 52', 53', 54', 55' are shown in a position for the maximum sheet size or format. When setting is made to a smaller sheet or format, the suction-type grippers 50', 51', 52', 53', 54', 55' can be displaced along the axis 58' either by hand or through the intermediary of a gear drive. As a result of the friction of the sealing rings 13', 14', 19', 20', 21', 22', 25' on the corresponding telescopic elements 11', 12', 15', 16', 23', 24', the suction-type grippers 50', 51', 52', 53', 54', 55' remain in their new positions The relative displacement of the suction-type grippers 50', 51', 52', 53', 54', 55' with respect to one another is possible within the framework of the lengths denoted by a, b, c, d and e. The positions of the suction-type grippers 50', 52', 54' after adjustment thereof to the minimum sheet size or format are shown by the center lines 59', 60', 61' The suction-air connection 9' may be a constituent part of a rotary lead-through permitting connection to a suction-air source fixed to the frame.

I claim:

1. Device for adjusting the position of suction-type grippers on a sheet-transfer drum, wherein the suction-type grippers, disposed basically along at least one generating line, are displaceable perpendicularly to a sheet-transport direction and are fixably disposed, comprising a multi-member differential worm-gear unit having output members secured against rotation relative thereto, the suction-type grippers being fastened to said output members, and precisely one rotational input member disposed on said differential worm-gear unit for simultaneously adjusting all of the suction-type grippers.

2. Device according to claim 1, wherein said input member is part of a gear drive, and including a drive motor for said gear drive, said drive motor being connected to a control device having an input for receiving signals relating to the sheet format.

3. Device according to claim 2, wherein said input member is a gearwheel.

4. Device according to claim 2, wherein said input member is a toothed-belt pulley.

5. Device according to claim 2, wherein said input member is a pinion of a chain drive.

6. Device according to claim 1, wherein said differential worm-gear unit contains a threaded spindle fixedly mounted on the sheet-transfer drum, said threaded spindle being disposed perpendicularly to the sheet-transport direction and, starting from said center thereof, which is in the center of the width of the sheet-transfer drum, being formed with a right-hand thread and a left-hand thread having single and double pitch, respectively, a first threaded sleeve disposed on either side of the center on each of the right-hand thread and the left-hand thread of the threaded spindle, both of said threaded sleeves being symmetrical with respect to the center and being formed as clutch halves of a dog clutch, said threaded sleeves, respectively, further including, towards the center, a first threaded section with a male left-hand thread and a right-hand thread of a half and a single pitch, respectively, respective output members of a first suction-type gripper being seated on each first threaded section, and said threaded sleeves, respectively, including, directly after said first threaded section, a second section with a male right-hand thread and a left-hand thread of a half and a single pitch, respectively, and including output members of a second suction-type gripper seated on each second threaded section, second threaded sleeves, respectively, connected coaxially on each of the first threaded sleeves on said threaded spindle on the side facing away from the center, said second threaded sleeves, respectively, having a male right-hand thread and a left-hand thread of 1.5-fold and three-fold pitch, respectively, respective output members of third suction-type grippers being positioned on said male threads, one of the second threaded sleeves on the end facing away from the center being drivable by said input member.

7. Device according to claim 6, wherein said first and said second threaded sleeves are each fixedly screwed together, and said male threads thereof are of like diameter.

8. Device according to claim 6, wherein said second threaded sleeves are each held on said threaded spindle at the end facing away from said center, and including a slide bearing and a bushing.

9. Device according to claim 1, wherein said input member is axially lockable relative to said worm-gear unit.

10. Device according to claim 1, wherein said differential worm-gear unit has threads which are self-locking.

11. Device according to claim 1, wherein said multi-member differential worm- gear unit includes a rotatable threaded spindle having a left-hand thread section and a right-hand thread section, respective nuts seated on the outside of said threaded spindle on each of said left-hand thread and said right-hand thread, displaceable drivers disposed on said threaded spindle between said nuts, compression springs disposed between said nuts and said respectively adjacent drivers and between adjacent drivers in the axial direction with respect to the threaded spindle, one of said suction-type grippers, respectively, being connected to each nut and to each driver.

* * * * *